US011519232B1

(12) United States Patent
Aldughaither

(10) Patent No.: US 11,519,232 B1
(45) Date of Patent: Dec. 6, 2022

(54) METHODS AND APPARATUS USING MODIFIED DRILLING FLUID WITH REALTIME TUNABLE RHEOLOGY FOR DOWNHOLE PROCESSES

(71) Applicant: Saudi Arabian Oil Company, Dhahran (SA)

(72) Inventor: Yazeed R. Aldughaither, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/305,907

(22) Filed: Jul. 16, 2021

(51) Int. Cl.
*E21B 21/08* (2006.01)
*E21B 37/00* (2006.01)
*E21B 7/06* (2006.01)

(52) U.S. Cl.
CPC ..... *E21B 21/08* (2013.01); *E21B 7/068* (2013.01); *E21B 37/00* (2013.01)

(58) Field of Classification Search
CPC ..... E21B 21/08; E21B 7/068; E21B 37/00
See application file for complete search history.

(56) References Cited

U.S. PATENT DOCUMENTS

| | | | | |
|---|---|---|---|---|
| 7,021,406 | B2 | 4/2006 | Zitha | |
| 7,082,078 | B2 | 7/2006 | Fripp et al. | |
| 9,181,470 | B2 | 11/2015 | Nguyen et al. | |
| 9,206,659 | B2 | 12/2015 | Zhang et al. | |
| 10,072,473 | B2 * | 9/2018 | Rud | E21B 31/06 |
| 10,900,303 | B2 | 1/2021 | Akbari et al. | |
| 10,989,041 | B2 | 4/2021 | Cromar et al. | |
| 11,306,555 | B2 * | 4/2022 | Althowiqeb | E21B 29/02 |
| 2003/0192687 | A1 | 10/2003 | Goodson et al. | |
| 2014/0299801 | A1 | 10/2014 | Alred et al. | |
| 2017/0241253 | A1 * | 8/2017 | Chapman | E21B 47/024 |
| 2019/0242208 | A1 | 8/2019 | Estrada-Giraldo et al. | |
| 2021/0140300 | A1 * | 5/2021 | Al-Rubaii | E21B 49/005 |

OTHER PUBLICATIONS

Zisis Vryzas et al.; Smart Magnetic Drilling Fluid With In-Situ Rheological Controllability Using Fe304 Nanoparticles; Mar. 6-9, 2017 SPE Middle East Oil & Gas Show and Conference; Society of Petroleum Engeneers (SPE).

* cited by examiner

*Primary Examiner* — Silvana C Runyan
(74) *Attorney, Agent, or Firm* — Leason Ellis LLP

(57) ABSTRACT

A method of cleaning a downhole section of a borehole delimited by side walls of a geological formation, the borehole containing a drill pipe having a bottom hole assembly with a drill bit and an electromagnet, and an annulus situated between the side walls and the drill pipe containing cutting debris resulting from drilling. The method comprises deploying a magnetorheological drilling fluid (MR fluid) into the downhole section through the drill pipe, the MR fluid entering the annulus through openings in the bottom hole assembly activating the electromagnet in the bottom hole assembly, the activated electromagnet generating a magnetic field modifies rheological properties of the MR fluid and increasing a transport rate at which cutting debris within the annulus is carried uphole in response to the magnetic field. Methods of providing hole stability and fluid displacement are also disclosed.

11 Claims, 5 Drawing Sheets

METHODS AND APPARATUS USING MODIFIED DRILLING FLUID WITH REALTIME TUNABLE RHEOLOGY FOR DOWNHOLE PROCESSES

FIELD OF THE DISCLOSURE

The present disclosure relates to oil and gas exploration and production, and, more particularly, relates to using a magneto-rheological fluid that changes properties when subject to a magnetic field for downhole applications including hole cleaning, enhancement of well stability and fluid displacement.

BACKGROUND OF THE DISCLOSURE

Downhole drilling processes utilize a drilling fluid which is usually a water or oil-based liquid with a number of chemical additives designed to achieve a desirable set of fluid properties. The drilling fluid is pumped from tanks on the surface through the inside of the drill string (the equipment formed by the drill bit, drill pipe, and various other tools at the bottom of the hole) out of the nozzles of the bit, and is recirculated back up to surface through the annulus between the outside of the drill string and the internal sides of geological formation of the hole. The main functions of the drilling fluid are to cool and lubricate the drill bit, to act as a medium to carry the drilled cuttings up to the surface, and to maintain hydrostatic pressure (the pressure generated by a vertical column of fluid) against the formation. The drilling fluid is continuously circulated from the surface down to the bottom-hole and back to surface while drilling operations are carried out.

During drilling it is necessary to transport the cuttings generated from drilling through the rock up to the surface. If the drilling fluid is not able to perform this function effectively, the drilled cuttings would accumulate at the bottom of the drilled hole, which leads poor drilling performance and malfunction. A well-designed drilling fluid is able to effectively transport these cuttings to surface as well as to suspend the cuttings in place even when the drilling fluid is not being circulated when the fluid pumps are not operating. This is usually controlled by the rheological properties of the fluid (primarily gel strength) as well as the pump rate and some other variables. One of the commonly used methods for ensuring effective hole cleaning is the use of high viscosity sweeps. A high viscosity sweep is the provision of a smaller volume of the drilling fluid that has been modified to have greater viscosity. The increased viscosity is typically achieved by the addition chemicals at the surface known as viscofiers or viscosifying agents. This approach has the disadvantage that it requires the addition of chemicals at the surface, which adds time and cost to the drilling operation.

Another issue commonly addressed through chemical modification of drilling fluid is well stability enhancement. There is tendency of some formations to collapse during drilling operations as a result of drilling through soft or unconsolidated rock types (e.g. chalk), or through reactive types of rock like shale. The conventional engineering response to address this is to increase the density of the drilling fluid as this has the effect of applying more force against the walls of the drilled hole, tending to stabilize the walls until the drilling of the pertinent section is completed. This approach has a number of disadvantages such as the possibility of inducing lost circulation which can occur when an under-pressured zone is drilled with the denser drilling fluid. This approach also necessitates the usage of more chemicals at the surface, which comes with added operational time and cost.

SUMMARY OF THE DISCLOSURE

The present disclosure provides a method of cleaning a downhole section of a borehole delimited by side walls of a geological formation, the borehole containing a drill pipe having a bottom hole assembly with a drill bit and an electromagnet, and an annulus situated between the side walls and the drill pipe containing cutting debris resulting from drilling. The method comprises deploying a magneto-rheological drilling fluid (MR fluid) into the downhole section through the drill pipe, the MR fluid entering the annulus through openings in the bottom hole assembly activating the electromagnet in the bottom hole assembly, the activated electromagnet generating a magnetic field modifies rheological properties of the MR fluid and increasing a transport rate at which cutting debris within the annulus is carried uphole in response to the magnetic field.

The present disclosure also addresses the problem of well stability. In this regard, the present disclosure provides a method of stabilizing a downhole section of a borehole delimited by side walls of a geological formation, the borehole containing a drill pipe having a bottom hole assembly with a drill bit and an electromagnet, and an annulus situated between the side walls and the drill pipe. The method comprising deploying a magnetorheological drilling fluid (MR fluid) into the downhole section through the drill pipe, the MR fluid entering the annulus through openings in the bottom hole assembly, activating the electromagnet in the bottom hole assembly, the activated electromagnet generating a magnetic field modifies rheological properties of the MR fluid and increasing an amount of force exerted by the MR fluid on the side walls of the formation in response to the magnetic field.

In addition, the present disclosure provides a method of displacing a first drilling fluid from a downhole section of a borehole delimited by side walls of a geological formation, the borehole containing a drill pipe having a bottom hole assembly with a drill bit and an electromagnet, and an annulus situated between the side walls and the drill pipe containing the first drilling fluid. The method comprises deploying a second drilling fluid with magnetorheological properties (MR fluid) into the downhole section through the drill pipe, the MR fluid entering the annulus through openings in the bottom hole assembly, activating the electromagnet in the bottom hole assembly, the activated electromagnet generating a magnetic field modifies rheological properties of the MR fluid, and stiffening the second MR drilling fluid in response to the magnetic field, the stiffened MR fluid acting as a spacer, displacing the first drilling fluid from the side walls.

In another aspect, a system for cleaning a downhole section of a borehole is provided. The borehole is delimited by side walls of a geological formation and contains a drill pipe having a bottom hole assembly with a drill bit and an electromagnet, and an annulus situated between the side walls and the drill pipe containing an MR fluid and cutting debris resulting from drilling. The system comprises a bottom hole apparatus positioned at the downhole section including i) a detector positioned in the downhole section adapted to detect and generate data related to an amount of accumulation of cutting debris in the downhole section and ii) an electromagnet. A controller is coupled to the bottom hole apparatus and is configured to receive activate the electromagnet based on whether the data generated by the detector indicates a threshold level of cutting debris has accumulated, wherein activation of the electromagnet modifies rheological properties of the MR fluid in the downhole section, causing an increase in a transport rate at which cutting debris within the annulus is carried uphole.

These and other aspects, features, and advantages can be appreciated from the following description of certain embodiments and the accompanying drawing figures and claims.

DESCRIPTION OF CERTAIN EMBODIMENTS OF THE DISCLOSURE

The present disclosure describes methods and apparatus that use magnetorheological (MR) drilling fluids that are capable of changing their rheological properties (such as yield point and apparent viscosity) when subjected to a magnetic field. By activating MR fluids using downhole magnetic fields, a significant increase in the MR drilling fluid's yield point and apparent viscosity, while maintaining the ability of drilling fluid to perform its primary functions such as maintaining well control, bit lubrication and cooling and cuttings transport. This real-time tunable rheology mitigates the time and cost impact of drilling challenges, and also increases the effectiveness of drilling fluid performance in regular drilling functions including well hole cleaning, well stability enhancement and fluid displacement during cementing operations.

Figure 1:
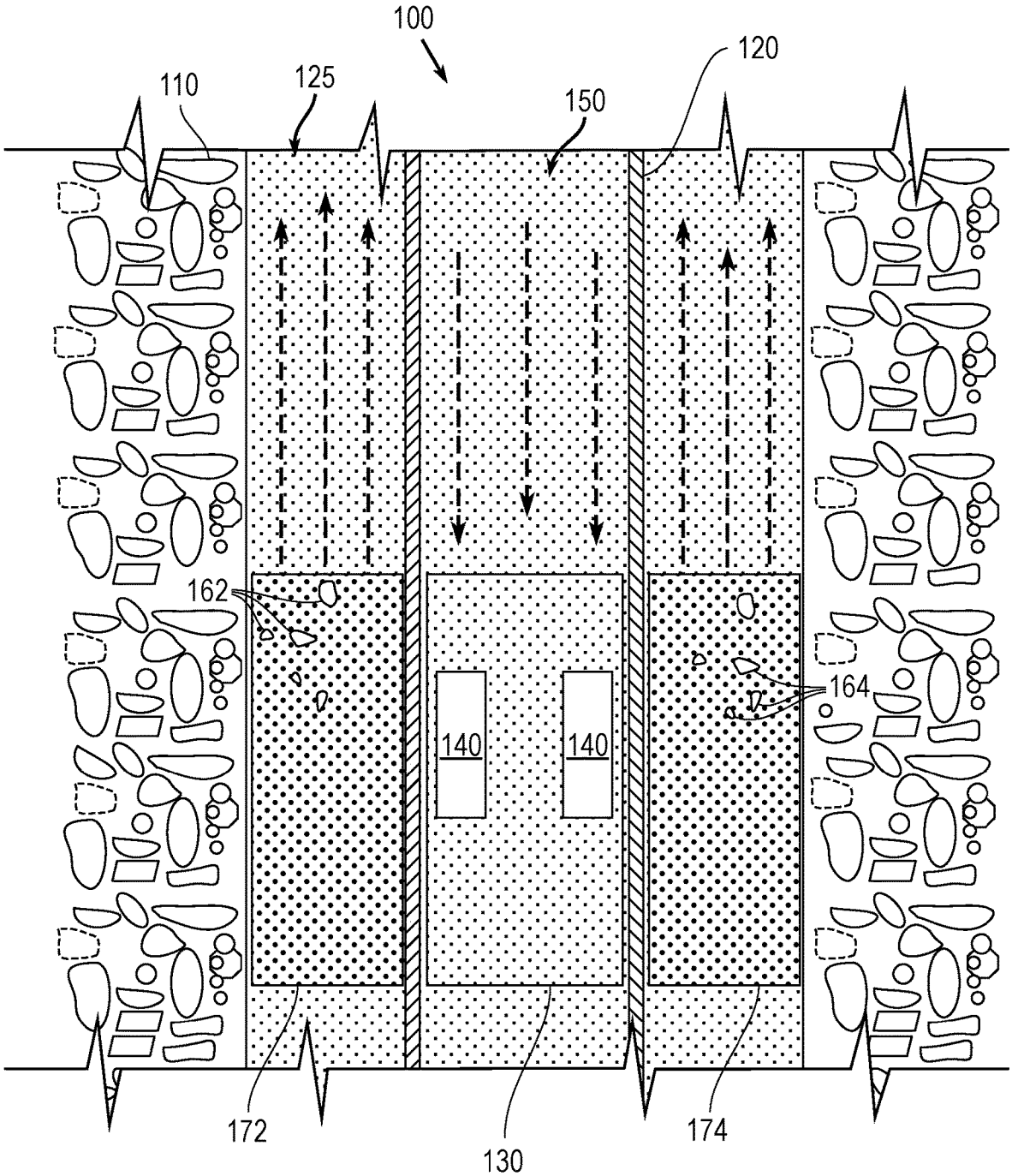
FIG. 1 is a schematic illustration of a downhole well section (bottom) in which an embodiment of an apparatus for modifying MR fluid downhole according to the present disclosure is deployed for hole cleaning.

FIG. 1 is a schematic illustration of a downhole well section (bottom) in which an embodiment of an apparatus for modifying MR fluid downhole according to the present disclosure is deployed. A borehole 100 has side wall 110 that can comprise cemented casings or the geological formation in which the hole has been drilled. In the bottom section shown, the side wall comprises geological rock material as a casing has not been constructed at this depth. Situated within the well bore 100 is a drill pipe 120 which extends from the surface (proximal end) or an upper section of the bore hole (not shown) to the bottom hole location (distal end) shown in the figure. Between the drill pipe 120 and the side wall is an annular region 125, referred to as the "annulus". A bottom hole assembly 130 is coupled to the drill pipe 120 at the distal end. The bottom hole assembly 130 includes the drill bit (not shown) and can also include collars, stabilizers and other equipment as known in the art. According to the present disclosure, the bottom hole assembly 130 also contains an electromagnet 140. The electromagnet 140 can be implemented with a simple solenoid, comprising of a coiled wire in the form of a helix.

An MR drilling fluid ("MR fluid") 150 is introduced into the drill pipe 120 to cool the drill bit and perform a number of other functions, including cleaning, stabilization and displacement. The MR fluid can be composed of a base oil (e.g. diesel oil), iron oxide nanoparticles which react to the magnetic field, and other mud additives (e.g. bentonite, barite, polymers, etc.) as appropriate for the specific application. In normal operation, drilling fluid that is introduced into the drill pipe 120 flows downwardly to the bottom hole assembly 130 (downward movement of drilling fluid in the drill pipe is shown in broken arrows) and is used to cool and lubricate the drill bit. The drilling fluid exits the drill pipe and enters the annulus 125. The drilling fluid is recirculated by flowing back upwards toward the well head through the annulus (upward movement of drilling fluid in the annulus is shown in broken arrows).

During drilling operations, rock material is cut out of the bottom of the hole and migrates to into the annulus 125. Over time, the cuttings can accumulate at the bottom of the drilled hole and also within the annulus 125. FIG. 1 shows exemplary cuttings 162, 164 suspended in the drilling fluid within the annulus. An overaccumulation of cuttings is a potential hazard because the cuttings lead to drilling difficulties and malfunctions, such as stuck pipes. Accordingly, it is important to regularly transport the cuttings 162, 164 upwardly through the annulus 125 and out of the downhole section before appreciable cutting accumulation occurs.

Figure 2:
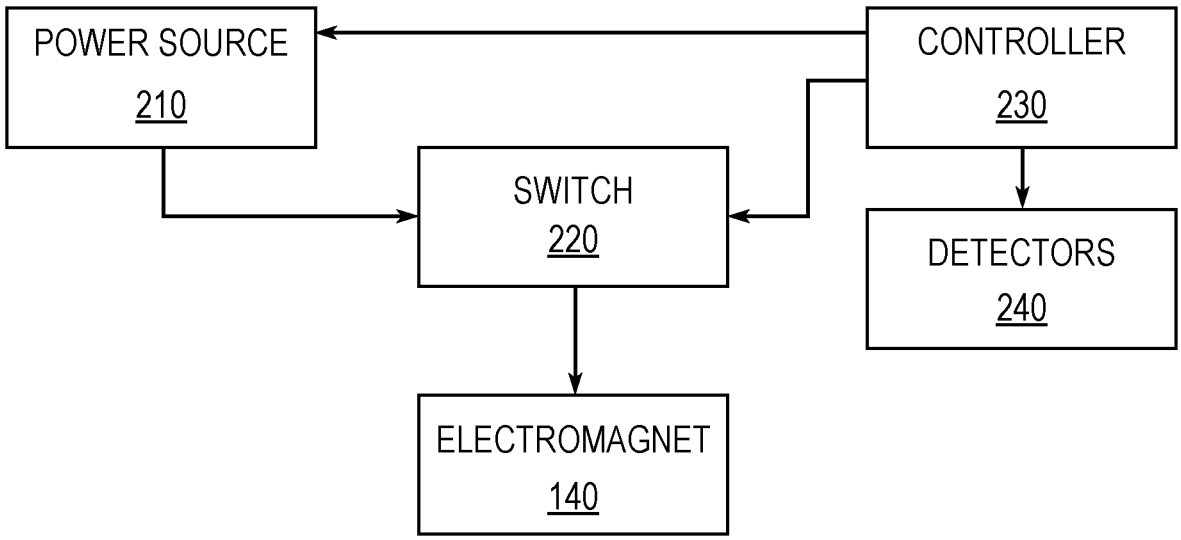
FIG. 2 is a schematic block diagram of an embodiment of an apparatus for modifying MR fluid downhole for promoting hole cleaning, well stability and displacement according to the present disclosure.

The apparatus for modifying MR fluid downhole according to the present disclosure promotes hole cleaning by modifying the rheological properties of the drilling fluid. FIG. 2 is a schematic block diagram showing such an apparatus 200 according to an embodiment of the present disclosure. A power source 210 supplies electrical power to a switch 220 which is also electrically coupled to the electromagnet 140 (shown in FIG. 1). A controller 230, which is preferably a surface-based computer system or electronic device is also coupled to switch 220. The controller 230 is configured to transmit signals from the surface to the downhole electromagnet 140 (via the switch 220) using one or more of: (i) mud telemetry (pulses sent through the drilling fluid), (ii) acoustic signals through soundwaves detectable by a downhole actuator, (iii) RFID chips in an appropriately enabled drill string, and (iv) through a wired drill pipe, sometimes referred to as smart/intelligent drill pipe. The controller 230 is further coupled to detectors 240 that detect downhole conditions such as pressure and temperature. The signal from the controller 230 controls the on/off state of the switch. In one of the conditions, for example the "on" state, the power source the channel from the power source 210 to the electromagnet 140 is opened and current flows from the power source 210 through the switch 220 to the electromagnet, causing the electromagnet to generate a magnetic field. The switch can include additional elements that can, in addition to turning current on and off, regulate the magnitude of the current when on. The magnitude of the current provided to the electromagnet can be modulated differently depending on the source of power. If the source of power is a mud motor, the current can be controlled with the flow rate of the supplied fluid. In the case of using a downhole battery, this can be achieved through mud telemetry as directed by signals from the controller 230.

In this manner the magnitude of the magnetic field generated by electromagnet 140 can be set by the controller 230.

The MR fluid in the bottom hole section that is exposed to the magnetic field generated by the electromagnet undergoes a change in rheological properties. Typically, exposure to a magnetic field of a sufficient strength causes an immediate increase in the apparent viscosity and yield point of the MR fluid (the yield point is defined as the attractive force among colloidal particles in the fluid). A typical range for the yield point is 15 to 35 lbs per square foot and for plastic viscosity a typical range is 10 to 40 cP. However, the values of these rheological parameters can vary considerably based on factors such as well type and design, the size of the hole section and the lithology of the encountered rock formations. Furthermore, the amount that the MR fluid parameters change upon exposure to the magnetic field depends on the specific formulation of the MR fluid, for example, the concentration of magnetic nanoparticles used, the magnitude of the field generated by the electromagnet, as well as downhole conditions such as temperature. It has been found that it is possible to achieve a six-fold increase in yield point when a sufficient magnetic particle concentration and magnetic field is provided.

The controller 230 can thereby set the rheological properties at a level that promotes a suitable upward velocity of drilling fluid within the annulus, known as the annular velocity. In contrast to chemical methods for increasing drilling fluid viscosity which require pumping new fluid downhole, the effect of activation of the MR fluid by the electromagnet is instantaneous. The magnitude of the change in rheological properties is directly correlated to the magnitude of current or power supplied to the electromagnet 140. This characteristic makes the fluid tunable in real time. Modulating the power delivered provides flexibility as to the degree of rheological enhancement in response to downhole conditions.

Returning to FIG. 1, when the electromagnetic 140 is activated to generate a magnetic field, the MR fluid in regions 172, 174 of the annulus which is exposed to the magnetic field of electromagnet 140 changes in rheological properties. The modified MR fluid will be able to more efficiently transport cuttings 162, 164 upwardly through the annulus and ultimately out of the borehole, to clean the hole. Once the hole is sufficiently cleaned, the apparatus 200 is deactivated and drilling operations can resume normally and without interruption. It is noted that detectors 240 can provide information regarding the accumulation of cuttings at the bottom hole assembly. In some implementations, the controller 230 can be configured to activate the electromagnet when a threshold amount of cutting debris has accumulated downhole.

Figure 5:
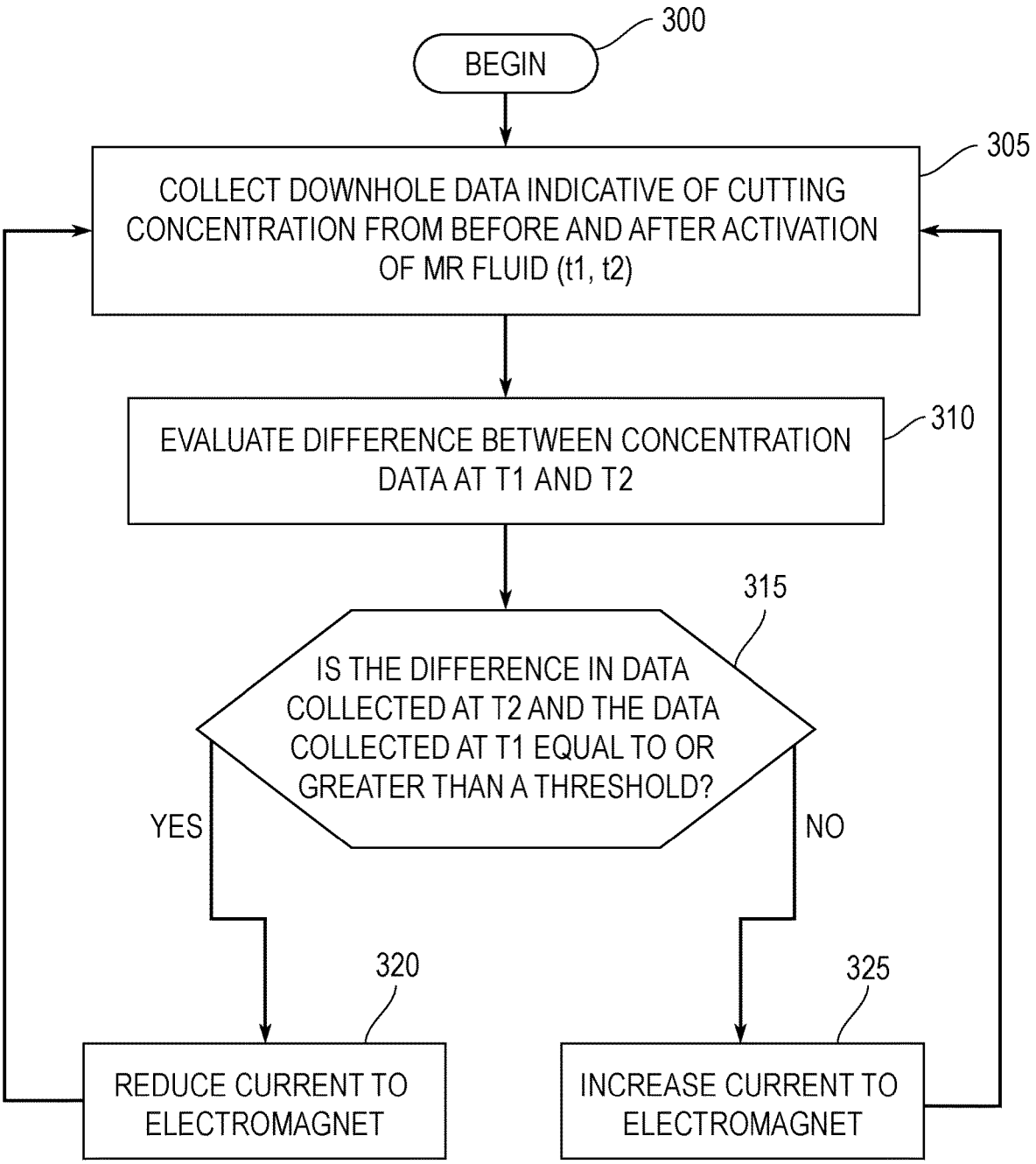
FIG. 5 is a flow chart of a method of automated hole cleaning according to an embodiment of the present disclosure.

The hole cleaning can be implemented in an automated fashion. FIG. 5 is a flow chart of a method of automated hole cleaning according to an embodiment of the present disclosure. The method can be executed by the controller 230 based on computer program instructions. The method begins in step 300. In step 305 downhole data is collected by detectors indicative of the amount or concentration of cuttings in the downhole section. The data is collected over a duration that ranges from before activation of the MR fluid to a point after the activation. The duration can be configurable by engineering personnel using controller 230. In step 310 the controller compares input from the detectors from before (t1) and after activation (t2) and determines a difference between them. In step 315, it is determined whether the difference between the detector data at t1 and t2 is equal to or greater than a present threshold. The threshold can be configured as a percentage change. The difference is a measure of the effectiveness of the hole cleaning. In one implementation, if the difference determined in step 315 is equal to or greater than the threshold, in step 320, the controller 230 generates and transmits a signal to the electromagnet 140 causing a reduction in current delivered to the electromagnet coil, decreasing the magnetic field applied to the MR. fluid. If, in step 315, it is determined that the difference in detector data between t1 and t2 is below the threshold, in step 325, the controller generates and transmits a signal to the electromagnet 140 causing an increase in the current delivered to the electromagnet coil, increasing the magnetic field applied to the MR field. After step 325 the method can cycle back to step 305 for further data collection. In this manner continuous closed loop control can be achieved. In other embodiments, the controller can turn the electromagnet on and off rather than regulate the magnitude of current provided. Further, the controller can implement open loop control in some implementations.

The apparatus for modifying MR fluid downhole can also be applied to enhancing well stability, particularly during drilling operations. One of the hazards of oil and gas production is the tendency of some formations to collapse while drilling. Collapse is often caused by drilling through soft or unconsolidated rock types (e.g. chalk) or reactive types of rock like shale. When a drilling site includes such geological formations, one engineering response is to increase the apparent density of the drilling fluid employed at the section being drilled. This measure has the effect of applying more force against the walls of the drilled hole, tending to stabilize the walls until the drilling is completed at the pertinent hole section. However, this approach can induce lost circulation in cases in which an under-pressured zone is drilled with the denser drilling fluid.

Figure 3:
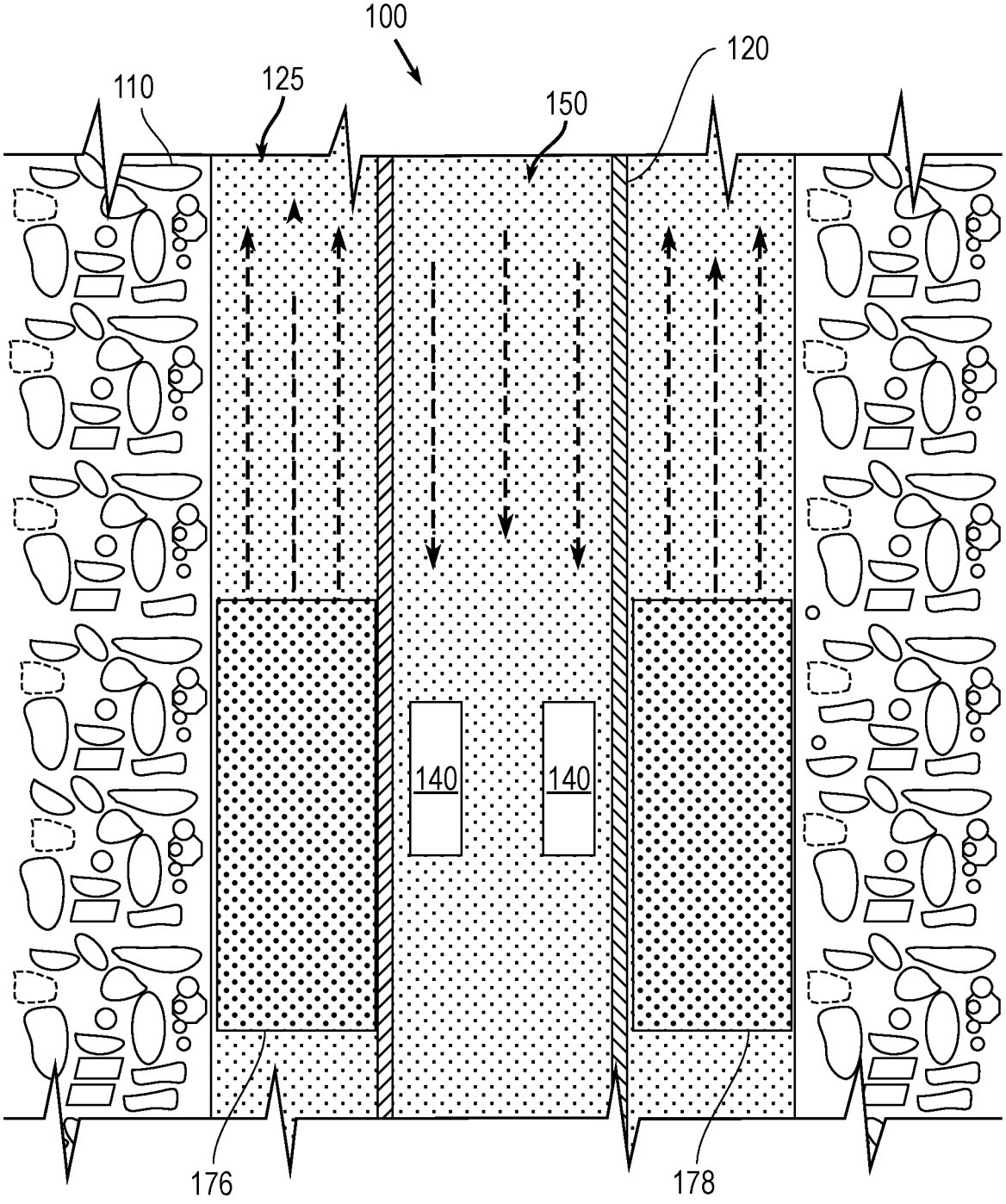
FIG. 3 is a schematic illustration of a downhole well section (bottom) in which an embodiment of an apparatus for modifying MR fluid downhole according to the present disclosure is deployed for enhancing well stability.

FIG. 3 is cross-sectional view showing the apparatus for modifying an MR fluid as shown in FIG. 1 used to enhance well stability. As shown, the electromagnet 140 is activated to increase the yield point and apparent viscosity of the MR fluid. The increase in the rheological properties of the MR fluid causes the MR fluid to exert additional force (shown by arrows in regions 176, 178) against the side walls 110 walls of the drilled hole, in effect mimicking the effect of an increase in density. The additional force supplied by the MR fluid supports the side wall 110 against collapse or other forms of instability such as caving or sloughing. It is again noted that this effect is instantaneous upon activation of the MR fluid. This method does not induce lost circulation as the conventional methods often do because the stiffening of the MR fluid imparts force to the side walls in a reactive manner and does not actively push against the walls. The activated MR fluid actually has a tendency to reduce flow due to its stiffness. This characteristic distinguishes it from methods that increase fluid density which cause fluid to breach the formation and cause lost circulation.

During casing construction, it is often necessary to displace drilling fluid from the annulus because the drilling fluid and the cement used to construct the casing are usually chemically incompatible. Without the displacement of the initial drilling fluid, the quality of the cement bond against the casing and the walls of the hole can deteriorate. Conventionally, a spacer fluid is pumped into the borehole which is meant to act as a buffer between the drilling fluid and cement. This spacer fluid clears out all the remaining drilling fluid so that the cement can effectively bond to the casing and hole walls. While this process has been well established in cementing operations, the displacement efficiency is inconsistent often requiring remedial operations known as workovers which are costly and time consuming.

Figure 4:
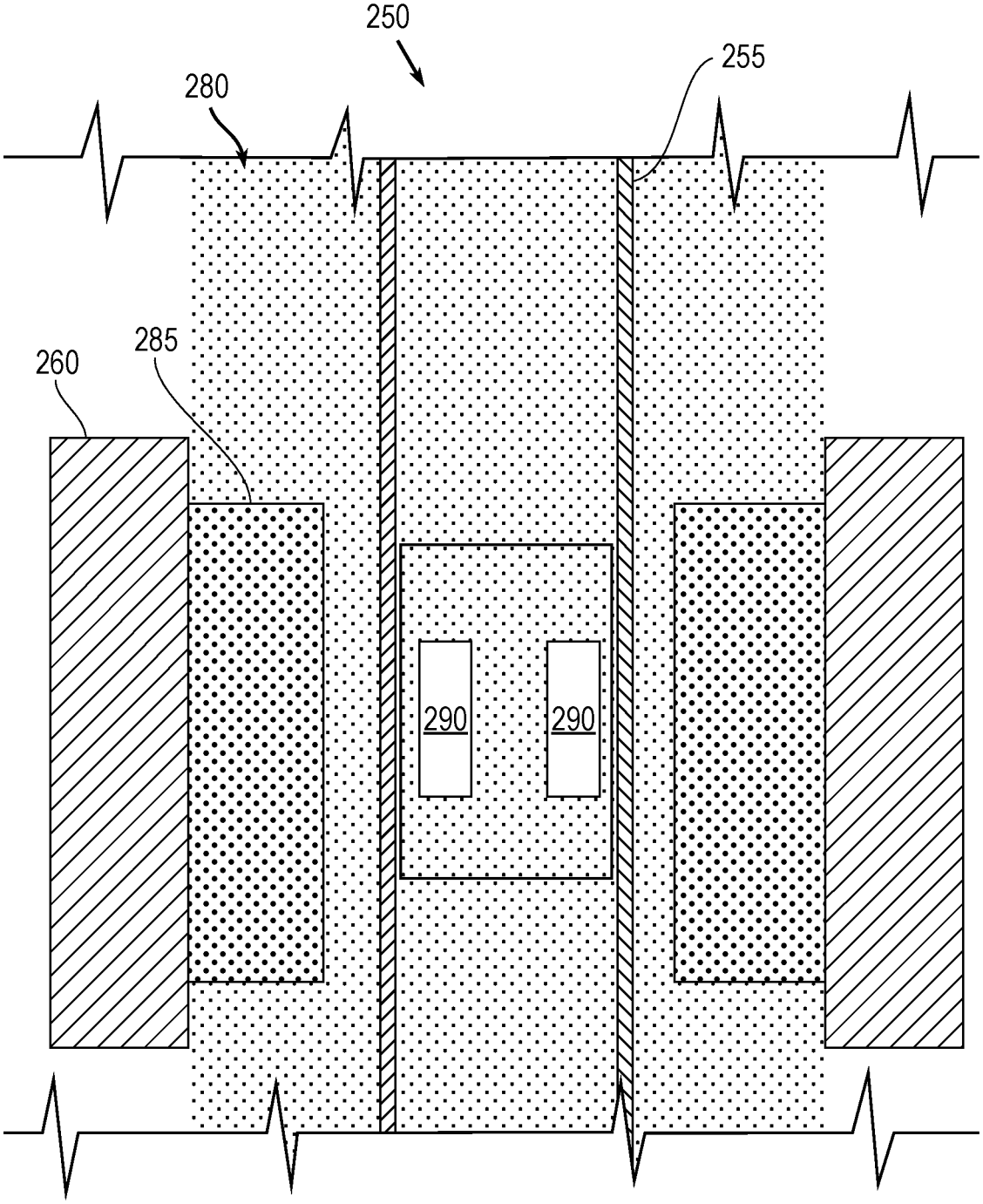
FIG. 4 is a cross-sectional view of a downhole section in which an embodiment of an apparatus for modifying MR fluid downhole according to the present disclosure is deployed for displacing drilling fluid.

FIG. 4 is a cross-sectional view of a downhole section 250 in which side wall casings 260 are being cemented. Between the drill pipe situated in the hole section 250 and the side wall 260 is an annulus in which contains a first drilling fluid 280, which can be a typical non-MR fluid. Within the downhole section 200, the drill pipe 255 contains an apparatus for modifying an MR fluid having an electromagnet 290. During cementing operations, an MR fluid (second fluid) 285 is injected downhole and reaches the pertinent downhole section 250. When the electromagnet 290 is activated as described above, the MR fluid 285 within the section stiffens and acts as a spacer, displacing the non-MR drilling fluid 280 away from the side wall 260. In this manner, the cement bonding of the side wall is safeguarded from deterioration due to exposure to the initial drilling fluid.

In sum, the deployment and activation of MR fluids downhole can be advantageously applied to solve problems involving cuttings transport, well stabilization and fluid displacement in a time and cost-effective manner.

It is to be understood that any structural and functional details disclosed herein are not to be interpreted as limiting the systems and methods, but rather are provided as a representative embodiment or arrangement for teaching one skilled in the art one or more ways to implement the methods.

It is to be further understood that like numerals in the drawings represent like elements through the several figures, and that not all components or steps described and illustrated with reference to the figures are required for all embodiments or arrangements.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the either of the terms "comprises" or "comprising", when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to a viewer. Accordingly, no limitations are implied or to be inferred.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. A method of cleaning a downhole section of a borehole delimited by side walls of a geological formation, the borehole containing a drill pipe having a bottom hole assembly with a drill bit and an electromagnet, and an annulus situated between the side walls and the drill pipe containing cutting debris resulting from drilling, the method comprising:

deploying a magnetorheological drilling fluid (MR fluid) into the downhole section of the borehole through the drill pipe, the MR fluid entering the annulus through openings in the bottom hole assembly;

activating the electromagnet in the bottom hole assembly, the activated electromagnet generating a magnetic field modifies rheological properties of the MR fluid; and increasing a transport rate at which cutting debris within the annulus is carried uphole in response to the magnetic field.

2. The method of claim 1, wherein the MR fluid is modified to increase in at least one of viscosity, yield point.

3. The method of claim 2, wherein the MR fluid has a yield point ranging from 15 to 35 pounds per square foot and a viscosity ranging from 10 to 40 cP.

4. The method of claim 1, further comprising:

detecting an amount of debris accumulated in the downhole section;

determining, using a processor, whether a threshold amount of debris has accumulated; and transmitting a signal to activate the electromagnet when it is determined that the threshold amount of debris has accumulated.

5. A method of stabilizing a downhole section of a borehole delimited by side walls of a geological formation, the borehole containing a drill pipe having a bottom hole assembly with a drill bit and an electromagnet, and an annulus situated between the side walls and the drill pipe, the method comprising:

deploying a magnetorheological drilling fluid (MR fluid) into the downhole section of the borehole through the drill pipe, the MR fluid entering the annulus through openings in the bottom hole assembly;

activating the electromagnet in the bottom hole assembly, the activated electromagnet generating a magnetic field modifies rheological properties of the MR fluid;

increasing an amount of force exerted by the MR fluid on the side walls of the formation in response to the magnetic field;

detecting a pressure exerted on the side walls of the formation;

determining, using a processor, whether a threshold amount of pressure is being exerted; and transmitting a signal to activate the electromagnetic when it is determined that a threshold amount of pressure is not being exerted on the side walls.

6. The method of claim 5, wherein the MR fluid is modified to increase in at least one of viscosity, yield point and density.

7. The method of claim 6, wherein the MR fluid has a yield point ranging from 15 to 35 pounds per square foot and a viscosity ranging from 10 to 40 cP.

8. A system for cleaning a downhole section of a borehole delimited by side walls of a geological formation, the borehole containing a drill pipe having a bottom hole assembly with a drill bit and an electromagnet, and an annulus situated between the side walls and the drill pipe containing an MR fluid and cutting debris resulting from drilling, the system comprising:

a bottom hole apparatus positioned at the downhole section of the borehole including:

a detector positioned in the downhole section of the borehole adapted to detect and generate data related to an amount of accumulation of cutting debris in the downhole section of the borehole; and an electromagnet;

a controller coupled to the bottom hole apparatus and configured to receive activate the electromagnet based on whether the data generated by the detector indicates a threshold level of cutting debris has accumulated, wherein activation of the electromagnet modifies rheological properties of the MR fluid in the downhole section of the borehole, causing an increase in a transport rate at which cutting debris within the annulus is carried uphole.

9. The system of claim 8, further comprising a power source for providing energy to the bottom hole apparatus.

10. The system of claim 9, wherein the power source comprises the a mud motor.

11. The system of claim 9, wherein the power source comprises a battery included in the bottom hoe apparatus.

* * * * *